US011536284B2

(12) United States Patent
Cunnane

(10) Patent No.: US 11,536,284 B2
(45) Date of Patent: Dec. 27, 2022

(54) CEILING FAN

(71) Applicant: HUNTER FAN COMPANY, Memphis, TN (US)

(72) Inventor: Jeffrey Butler Cunnane, Phoenix, AZ (US)

(73) Assignee: Hunter Fan Company, Memphis, TN (US)

( * ) Notice: Subject to any disclaimer, the term of this patent is extended or adjusted under 35 U.S.C. 154(b) by 0 days.

(21) Appl. No.: 16/989,970

(22) Filed: Aug. 11, 2020

(65) Prior Publication Data

US 2022/0049718 A1 Feb. 17, 2022

(51) Int. Cl.

| | |
|---|---|
| ***F04D 25/08*** | (2006.01) |
| ***F04D 29/54*** | (2006.01) |
| ***F04D 25/02*** | (2006.01) |
| ***F04D 19/00*** | (2006.01) |

(52) U.S. Cl.
CPC ..... *F04D 25/088* (2013.01); *F04D 19/002* (2013.01); *F04D 25/02* (2013.01); *F04D 29/545* (2013.01)

(58) Field of Classification Search
CPC ..... F04D 19/022; F04D 25/02; F04D 25/088; F04D 29/545; F04D 29/547; F24F 13/08
USPC ..... 454/358, 362, 363
See application file for complete search history.

(56) References Cited

U.S. PATENT DOCUMENTS

| | | | | |
|---|---|---|---|---|
| 2,705,623 | A * | 4/1955 | Glassenhart | B60H 1/3202 261/29 |
| 6,669,436 | B2 | 12/2003 | Liu | |
| 8,033,783 | B2 | 10/2011 | Ishikawa et al. | |
| 9,004,858 | B2 | 4/2015 | Nicolas et al. | |
| 9,194,596 | B2 | 11/2015 | Dyson et al. | |
| 9,528,529 | B1 | 12/2016 | Kraft | |
| 9,534,610 | B2 | 1/2017 | Stewart et al. | |
| 9,631,627 | B2 | 4/2017 | Avedon | |
| 9,714,663 | B1 | 7/2017 | Avedon | |
| 9,797,413 | B2 | 7/2017 | Stewart et al. | |
| 9,719,525 | B2 | 8/2017 | Cunnane | |
| 9,797,411 | B2 | 10/2017 | Dyson et al. | |
| 10,309,667 | B2 | 6/2019 | Choo et al. | |
| 10,352,325 | B2 | 7/2019 | Hiner et al. | |
| 10,487,852 | B2 | 11/2019 | Avedon | |
| 2014/0227961 | A1* | 8/2014 | Yasutomi | F24F 11/72 137/829 |
| 2018/0345761 | A1* | 12/2018 | Kaneda | B60H 1/3421 |
| 2019/0072288 | A1* | 3/2019 | Niemiec | F21V 33/0096 |
| 2019/0292315 | A1* | 9/2019 | Niemiec | A61L 9/20 |
| 2019/0353173 | A1 | 11/2019 | Kraft | |
| 2020/0116165 | A1 | 4/2020 | Loercher | |
| 2020/0354513 | A1* | 11/2020 | Niemiec | F04D 25/088 |

* cited by examiner

*Primary Examiner* — Kenneth J Hansen
(74) *Attorney, Agent, or Firm* — McGarry Bair PC

(57) ABSTRACT

A ceiling fan or ceiling fan includes a body defining an interior passage having an inlet and an outlet provided on the body. The inlet, outlet, and interior passage can be annular. An impeller is mounted within the interior passage and driven by a motor mounted within the body to draw a volume of air through the interior passage from the inlet to the outlet. A deflector is provided within the body and extending through the outlet including an upper angled surface and a lower angled surface to direct the air in a generally upward or generally downward direction, respectively.

20 Claims, 7 Drawing Sheets

CEILING FAN

TECHNICAL FIELD

This disclosure relates to the field of ceiling fans as well as heating, ventilating, or air condition, and more specifically, to ceiling-mounted fluid-movement devices.

BACKGROUND

Ceiling fans can include a set of blades rotatably coupled to a motor assembly to rotate the set of blades. Rotation of the set of blades drives a volume of fluid, typically ambient air within a room, space, or area. Ceiling fan blades include a traditional aesthetic, commonly having a centralized rotating motor, for rotatably driving a set of blades mounted to the motor.

BRIEF DESCRIPTION

In one aspect, the disclosure relates to a ceiling fan comprising: a body defining an interior passage having an inlet and an outlet provided on the body; a motor located within the body; an impeller located within the body and rotatably driven by the motor to draw a volume of air through the interior passage from the inlet to the outlet; and a deflector coupled to the body with an upper angled surface and a lower angled surface each arranged at the outlet.

In another aspect, the disclosure relates to a ceiling fan comprising: a motor housing including an annular interior passage extending from an annular inlet to an annular outlet, with the annular outlet including a first angled edge spaced from a second angled edge by a peripheral gap; a downrod for suspending the motor housing from a structure; a motor provided within the motor housing; an impeller provided within the interior passage for moving a volume of air from the inlet to the outlet; a deflector extending through the peripheral gap including an upper angled surface and a lower angled surface, with the upper angled surface shaped complementary to the first angled edge of the annular outlet and with the lower angled surface shaped complementary to the second angled edge; wherein the deflector directs air exhausting from the outlet in a generally upward direction when the deflector is in a first position with the lower angled surface confronting the second angled edge and wherein the deflector directs air exhausting from the outlet in a generally downward direction when the deflector is in a second position with the upper angled surface confronting the first angled edge.

In yet another aspect, the disclosure relates to a ceiling fan comprising: a motor housing body including an annular inlet and an annular outlet; a deflector positioned at and partially defining the outlet, with the deflector including an upper angled surface and a lower angled surface; wherein the deflector is movable between a first position and a second position, where the deflector directs air exhausting from the outlet in a generally downward direction along the lower angled surface in the first position, and where the deflector directs air exhausting from the outlet in a generally upward direction along the upper angled surface in the second position.

DETAILED DESCRIPTION

Figure 1:
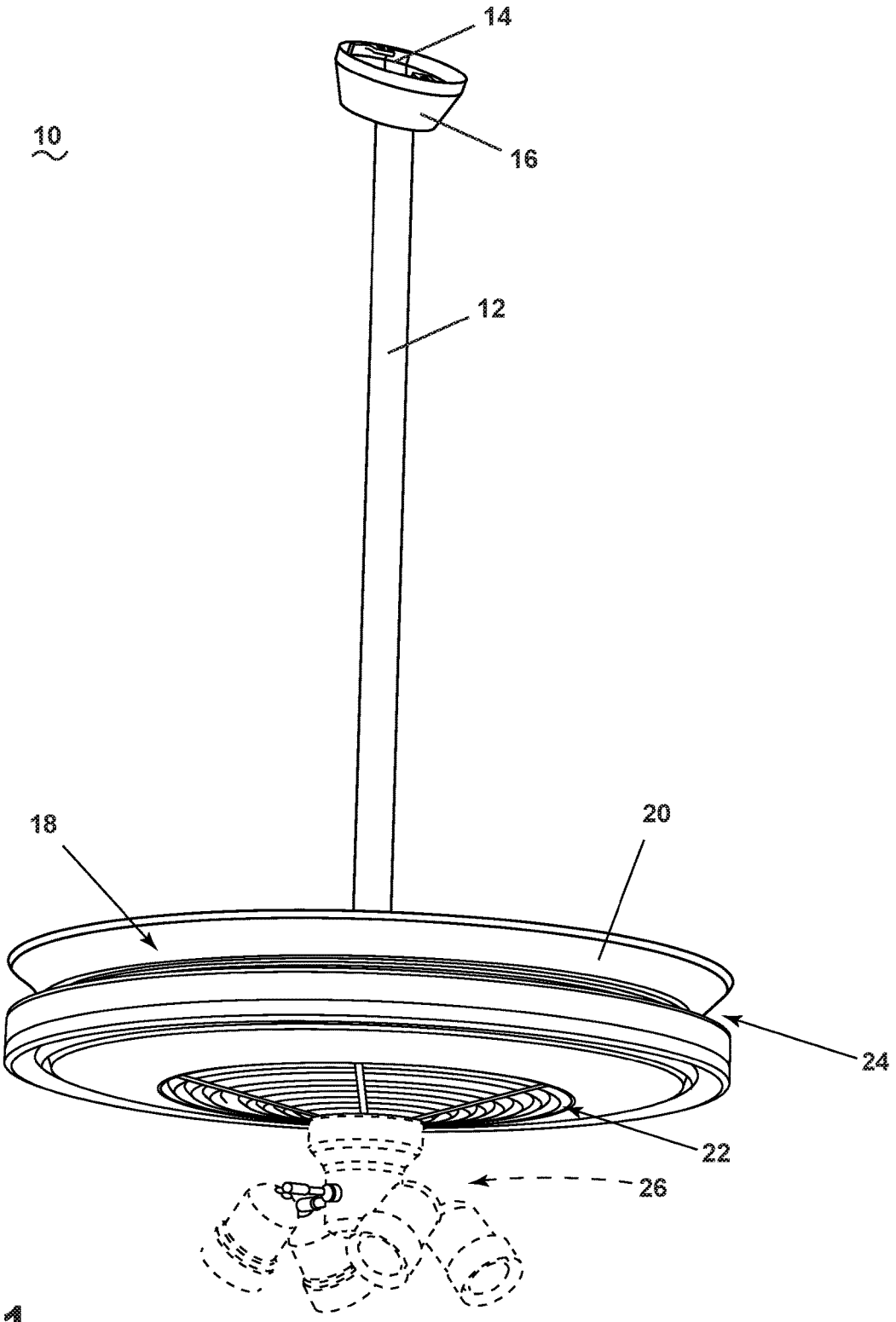
FIG. 1 is a perspective view of an assembled ceiling fan, with an optional light kit shown in dashed lines.

The disclosure provided herein relates to a ceiling-mounted fan or a ceiling fan, and more specifically, to an impeller-type ceiling fan having an impeller to drive an airflow as opposed to a ceiling fan having a set of radially-extending blades open to the environment. It should be understood that the impeller includes a set of mounted blades, but can be formed as a singular unit for driving a circumferential airflow, as opposed to individual blades each driving an airflow individually.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary. As used herein, the term "set" or a "set" of elements can be any number of elements, including only one. For example, a set of grommets or a set of blades as used herein can include one or more grommets, or one or more blades.

Referring to FIG. 1, a ceiling fan, or ceiling fan 10 can be suspended from a structure, or ceiling thereof, by a downrod 12 mounted to the ceiling at a mount bracket 14. A canopy 16 can be used to cover the mount bracket 14 at the ceiling. A body 18 of the ceiling fan 10 is suspended from the downrod 12 opposite of the mount bracket 14. The body 18 can include a housing 20 and an optional light kit 26, shown in broken lines. The housing 20 can include an inlet 22 and an outlet 24. The inlet 22 can be provided on a bottom portion of the housing 20, while the outlet 24 is provided on the side of the housing 20, spanning the periphery of the body 18. In this way, the inlet 22 and the outlet 24 can be annular. It should be appreciated that and airflow can be reversed, such that the inlet 22 becomes the outlet 24 and the outlet 24 becomes the inlet 22 based upon the direction of the airflow.

Figure 2A:
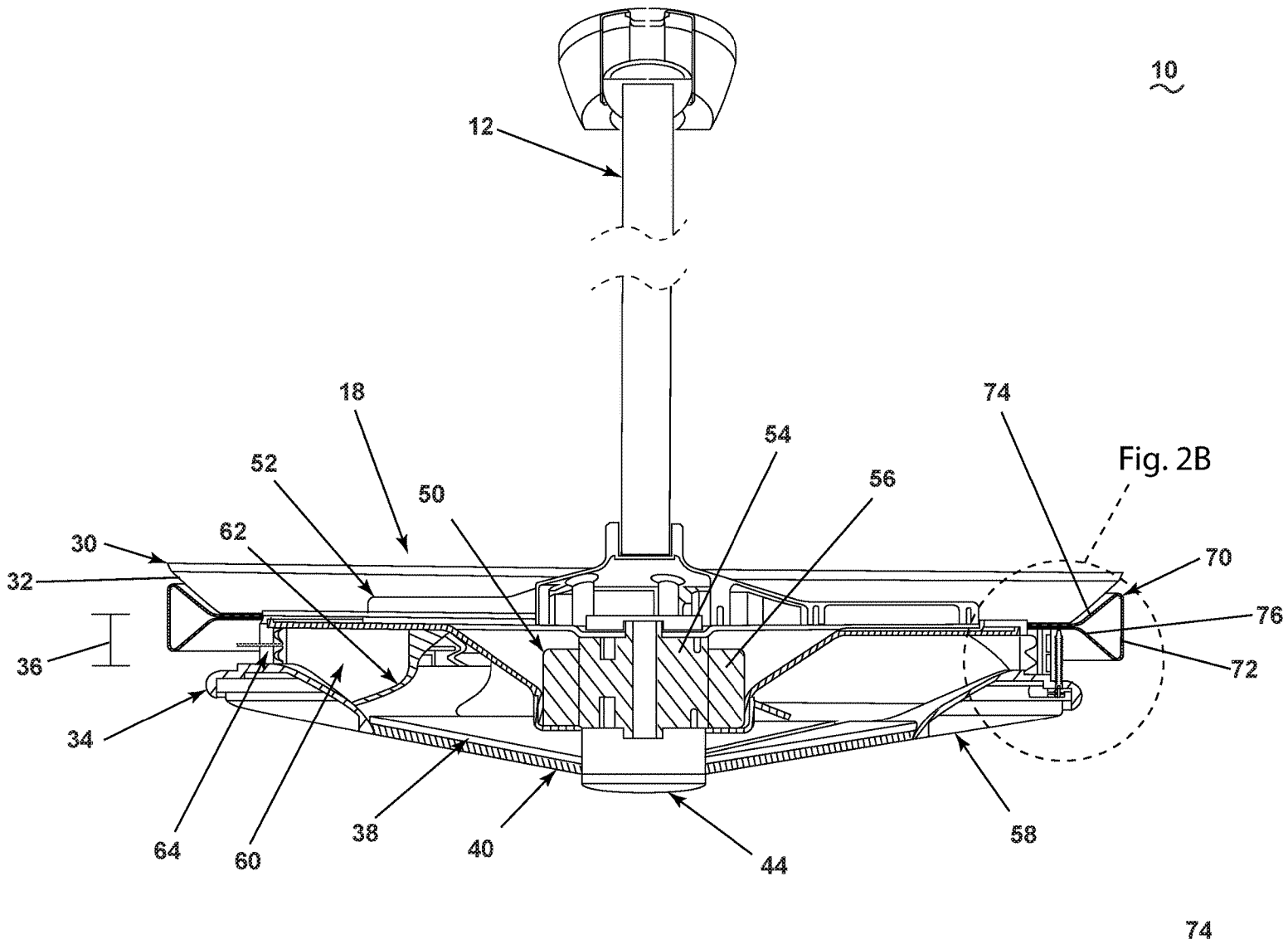
FIG. 2A is a section view of the ceiling fan of FIG. 1 with a deflector in a first position.

Referring to FIG. 2A, the body 18 can include a top plate 30. The top plate 30 includes an angled surface 32, which can partially define the outlet 24. An impeller shroud 34 can also form a portion of the body 18. A shroud cover 44 can provide for covering the bottom of the impeller shroud 34, for covering interior components and improving aesthetic appeal. The impeller shroud 34 is spaced from the top plate 30, defining the outlet 24 as a peripheral gap 36 between the impeller shroud 34 and the top plate 30. The inlet 22 can be formed and defined wholly or partially by the impeller shroud 34. The impeller shroud 34 can further include a filter 38, which can cover the inlet 22 and filter any fluid or air drawn into the inlet 22. A filter cover 40 can mount to the impeller shroud 34 to cover the filter 38. In one non-limiting example, the filter cover 40 can include a set of louvers or other physical structure to support the filter 38 and protect the filter 38 and inlet 22 from foreign material, debris, or from unintended strikes hitting the ceiling fan 10.

A motor 50 can be mounted within the body 18. The motor 50 can affix to the downrod 12, such as by utilizing a motor adapter or motor coupler to suspend the motor 50 and the body 18 from the ceiling or structure. In one example, the top plate 30 can include an interior skeleton structure 52 used to mount the motor 50 to the downrod 12. The motor 50 can further include a stator 54 and a rotor 56, with the rotor 56 being rotatably driven by the stator 54. The motor 50, as well as the stator 54 thereof, can be fixedly suspended from the downrod 12. An electrical or power supply (not shown) can power the motor 50, and can be connected to the motor 50 via wiring passing through the downrod 12. Additionally, it is contemplated that the motor 50, a motor assembly, or the electrical supply line can include a controller which can be used to operate the ceiling fan. Similarly, the controller can include wireless technology, such that wireless operation of the ceiling fan 10 can be achieved remotely and wirelessly.

A lower cover 58 can be provided beneath the motor 50 and can mount to the remainder of the body 18 or motor 50, such as via the motor shaft, or can be mounted to the impeller shroud 34. The lower cover 58 can also cover the lower interior components for protection and for aesthetic purposes. The lower cover 58 can optionally be replaced with the light kit 26, which can be electrically coupled to the motor 50, such as that shown in FIG. 1.

An interior passage 60 can be defined through the body 18, having an annular geometry, fluidly coupling the inlet 22 to the outlet 24. The interior passage 60 can be at least partially defined by the top plate 30 and the impeller shroud 34. An impeller 62 can be mounted to the rotor 56, such that operation of the motor 50 rotatably drives the impeller 62 within the interior passage 60. Driving the impeller 62 pulls fluid or air into the interior passage 60 through the inlet 22 and expels the fluid or air from the interior passage 60 via the outlet 24. A set of guides 64, such as stationary foils, louvers, or airfoils, can be arranged downstream of and peripheral to the impeller 62 or the rotation thereof. Such a set of guides can provide for improving airflow efficiency as well as reducing noise or vibration generated by the impeller 62.

A deflector 70 is mounted to the body 18. The deflector 70 can include an annular shape, extending through a portion of the interior passage 60 and extending through the outlet 24. The deflector 70 can include a peripheral end 72. The peripheral end 72 can include a triangular-shaped profile, including an upper angled surface 74 and a lower angled surface 76. The upper angled surface 74 can be complementary to the angled edge 32 of the top plate 30, and the lower angled surface 76 can be similarly shaped. In one example, the upper and lower angled surfaces 74, 76 can be arranged at 45-degrees, relative to the horizontal. In another example, it is contemplated that the upper and lower angled surfaces 74, 76, as well as the angled edge 32 or any surface defining the outlet 24 can be curved, such as having an airfoil shape, or a portion thereof, as opposed to the surfaces as shown.

Figure 2B:
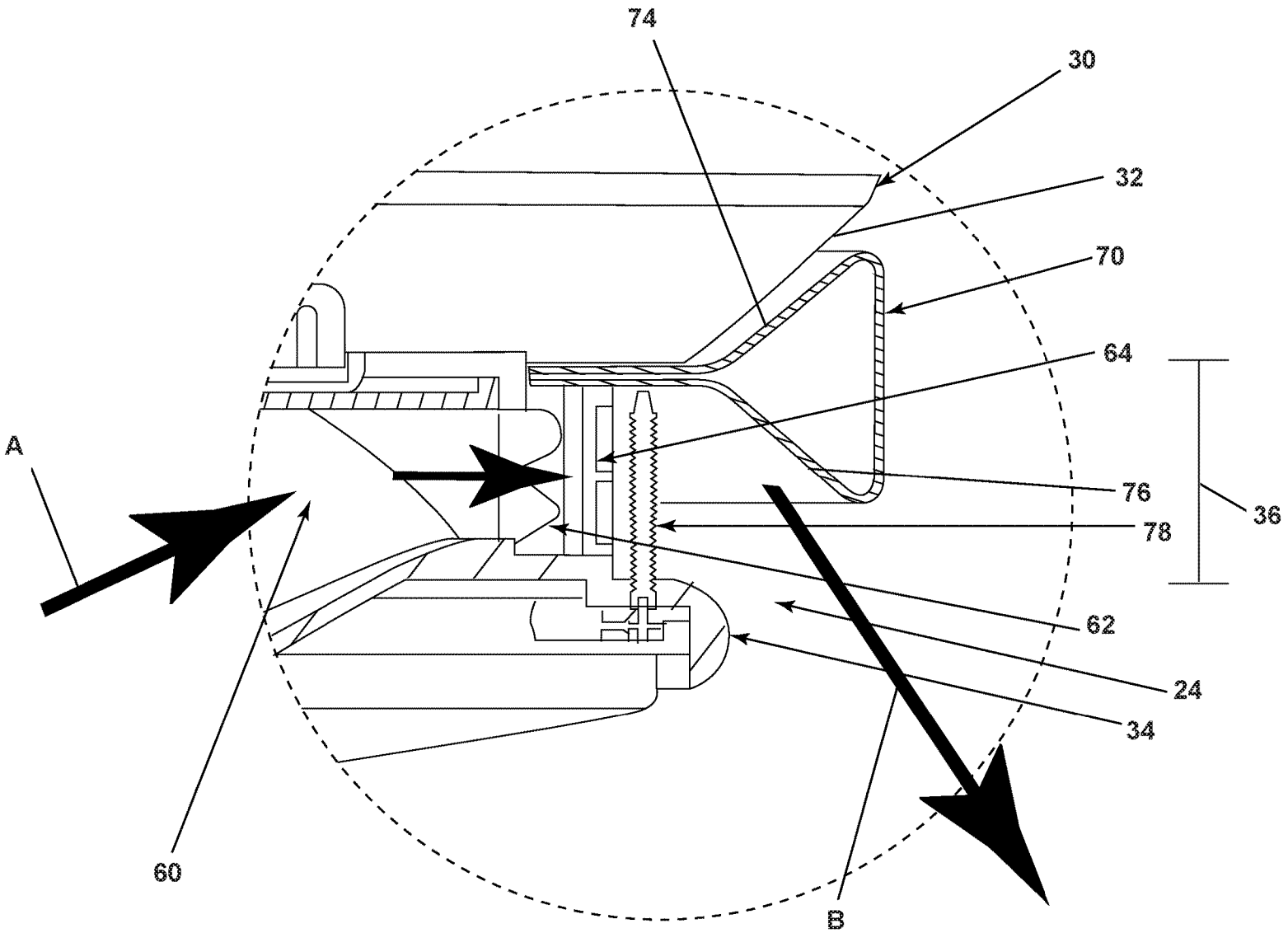
FIG. 2B is an enlarged detail view of a portion of FIG. 2A, showing the deflector in the first position.

Referring now to the enlarged view of FIG. 2B, one may better appreciate the structure of the ceiling fan 10 at the outlet 24. The peripheral gap 36 is defined between the top plate 30 at the bottom of the angled edge 32 and the impeller shroud 34. The impeller 62 is driven by the motor 50, which draws air through the interior passage 60 and exhausts the air from the outlet 24. The air can pass along one or more of the set of guides 64, which can be used to have an effect on the airflow, such as providing a directionality, or increasing or decreasing local pressures or air speeds, or can rectify cyclical pressure waves that can otherwise generate noise.

The deflector 70 can be positioned adjacent the top plate 30, in a first position, with the upper angled surface 74 positioned adjacent and along the angled edge 32 of the top plate 30. In such a position, the lower angled surface 76 will direct airflow exhausting from the outlet 24 in a downward direction away from or parallel to the angled edge 32 of the top plate 30. In the first position, the deflector 70 can direct the air exhausting from the outlet 24 in a generally downward direction. The general downward direction can be defined at the outlet 24 by the deflector 70 and the impeller shroud 34 at the outlet 24.

A generally downward direction can be defined as a direction that is directed more away from the ceiling or structure from which the ceiling fan 10 suspends, than in a direction toward the ceiling. In one example, the horizontal can be a line of delineation between determining a generally downward direction versus a generally upward direction toward the ceiling. Thus, it should be understood that a downward direction need not be away from the ceiling in a perpendicular or orthogonal manner, but angled in a direction away from the ceiling, relative to a direction parallel to the ceiling, such as the horizontal. Similarly, in one example, the upper angled surface 74, the lower angled surface 76, and the angled edge 32 (as well as any other angled edge, such as that of the impeller shroud 34 at the outlet 24) can be shaped to direct the airflow at an upward angle of 45-degrees or a downward angle of 45-degrees, relative to the horizontal, while other angles are contemplated. Non-limiting examples of angles in a generally downward direction or a generally upward direction can include 30-degrees, 45-degrees, 60-degrees, or any suitable angle between 0-degrees and 90-degrees. It should be appreciated that the particular ceiling fan may utilize variable angles, such as by varying or changing the deflector 70, as different angles may be beneficial to different environments, considering factors such as volume of the room in one non-limiting example.

The deflector 70 can be moved to and held in the first position by a positioning means or actuator 78. In one example, the actuator 78 can be a threaded shaft, which can be used to manually adjust the position of the deflector 70. Adjusting the deflector 70 can include raising or lowering the deflector 70, where the first position is the fully raised position and the second position is the fully lowered position. It should be understood that other implementations are possible, and there may be other methods of positioning the deflector 70. In another example, the actuator 78 can be a mechanical actuator controlled by a controller, which can be used to mechanically move the deflector between the first position (FIG. 2B) and a second position (better described in relation to FIG. 2C). In another example, the actuator can be a manually operated, where the user can manually change between the first position and the second position.

In operation, when the deflector 70 is in the first position, airflow A pushed through the interior passage 60 by the impeller 74 is exhausted from the outlet 24 as an exhaust flow B. The deflector 70 pushes the airflow A in the generally downward direction, directing the airflow A with the lower angled surface 76 to exhaust the flow as the exhaust flow B that is in the generally downward direction.

Figure 2C:
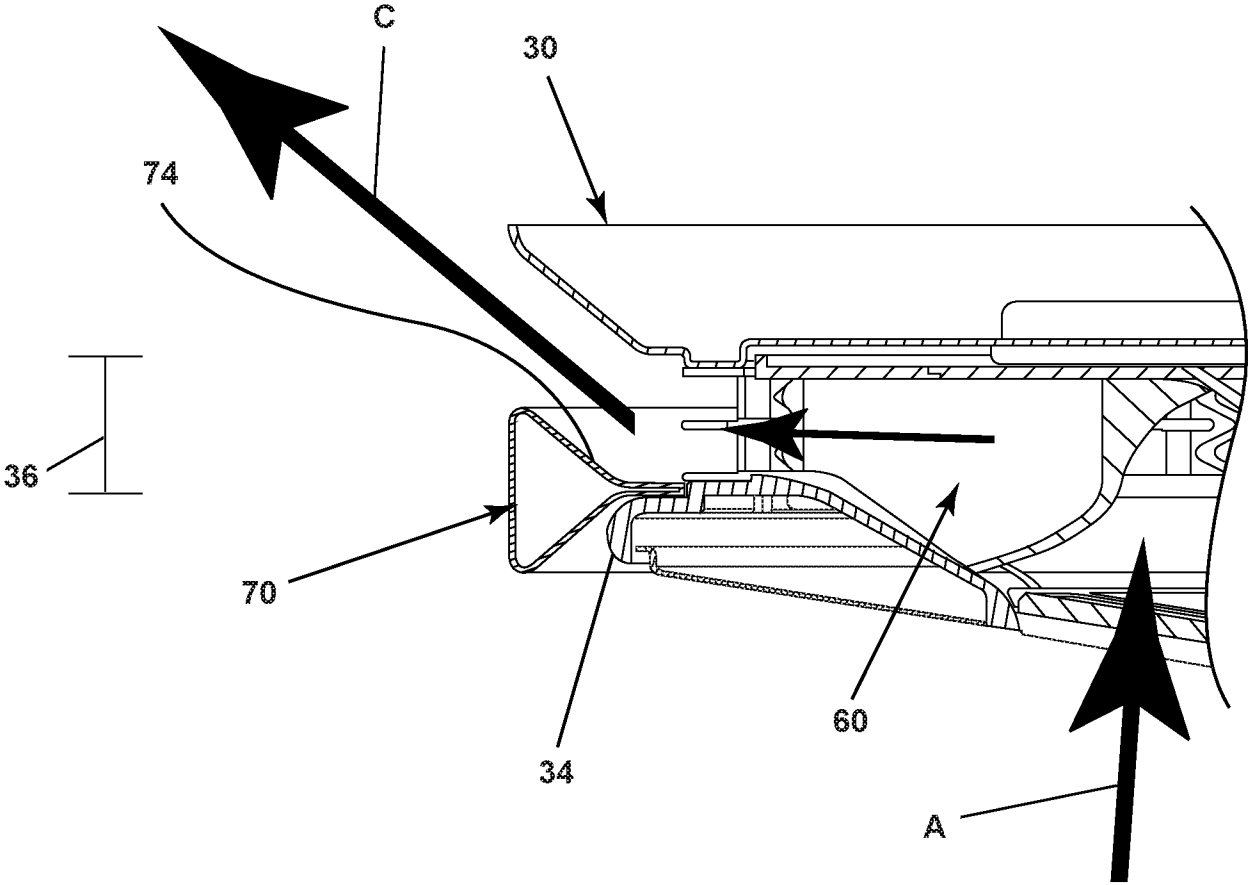
FIG. 2C is an enlarged detail view of a portion of FIG. 2A, showing the deflector in the second position.

Referring to FIG. 2C, the deflector 70 has been moved to the second position, such as by actuation or removal of the actuator 78 from the first position shown in FIG. 2B. In the second position the deflector 70 is adjacent to the impeller shroud 34 at the other side of the peripheral gap 36. In one example, the deflector 70 can rest on the impeller shroud 34, while it is contemplated that a more fixed approach, such as fixed in the second position by an actuator, can reduce vibration or noise from the deflector 70. In the second position, air exhausting from the interior passage 60 is deflected against the upper angled surface 74 of the deflector 70, and directed in a generally upward direction toward the ceiling, relative to the horizontal, similar to that described in reference to FIG. 2B. As described herein, a generally upward direction can be in a direction that is toward the ceiling, as opposed to away from the ceiling, such as relative to the horizontal. It is further contemplated that the actuator 78 need not be limed to a first and second position as described herein, but can be positioned in variable positions, between the first position and the second position. In such a position, it is contemplated that the airflow can be exhausted from the outlet 24 in both a generally upward direction and a generally downward direction.

In operation, air is drawn into the interior passage 60 by the impeller 62 as initial airflow A. The air is exhausted from the outlet 24 in a generally upward direction by deflecting the airflow A along the upper angled surface 74, exhausting as an exhausted airflow C in a generally upward direction. It should also be appreciated that an embodiment of the ceiling fan can be configured such that the actuator 78 can move the deflector in a continuous, cyclical manner, cycling between or among the first position or the second position, which the rate of variation can be controlled by the user. Such a system can provide for variation in the airflows generated from the ceiling fan.

Figure 3:
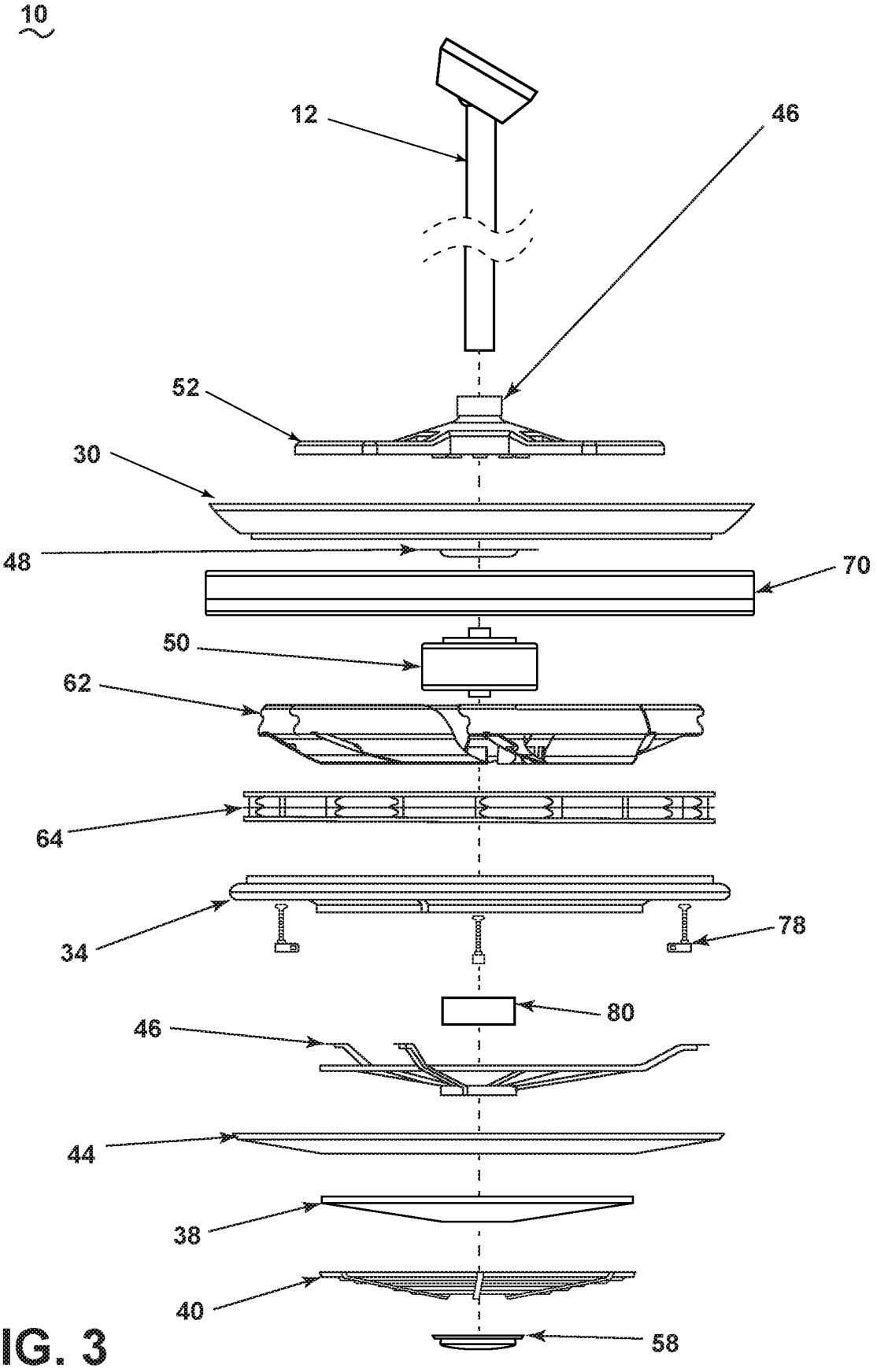
FIG. 3 is an exploded view of the ceiling fan of FIGS. 1-2C.

Referring to FIG. 3, an exploded view of the ceiling fan 10 is provided, which can be used to describe the assembly of the ceiling fan 10. In assembly, the downrod 12 can couple to the skeleton structure 52, including a motor coupler 42 for securing the skeleton structure 52 to the motor 50. A spacer 48 can be provided for spacing the motor 50 from the skeleton structure 52. The top plate 30 can mount to and position upon the skeleton structure 52. The motor 50 and the set of guides 64 can mount to the skeleton structure 52. The impeller 62 can mount to the motor 50 to be rotatably driven by the motor 50. The actuators 78 or guides thereof can mount to and extend from the impeller shroud 34, and extend to the top plate 30 to permit movement of the deflector 70 between the top plate 30 and the impeller shroud 34 in the first and second positions, respectively. The lower cover 58, the filter 38, the filter cover 40 can mount to the impeller shroud 34 at the shroud cover. Additionally, a support 46 can be mounted within the impeller shroud 34 for supporting the filter 38, as well as other components. A controller 80 can be provided within the lower cover 58, akin to a switch housing, which can be utilized for controlling or operating the ceiling fan 10. Similarly, the controller 80 can be used to power and operate a light provided in place of the lower cover 58.

Figure 4:
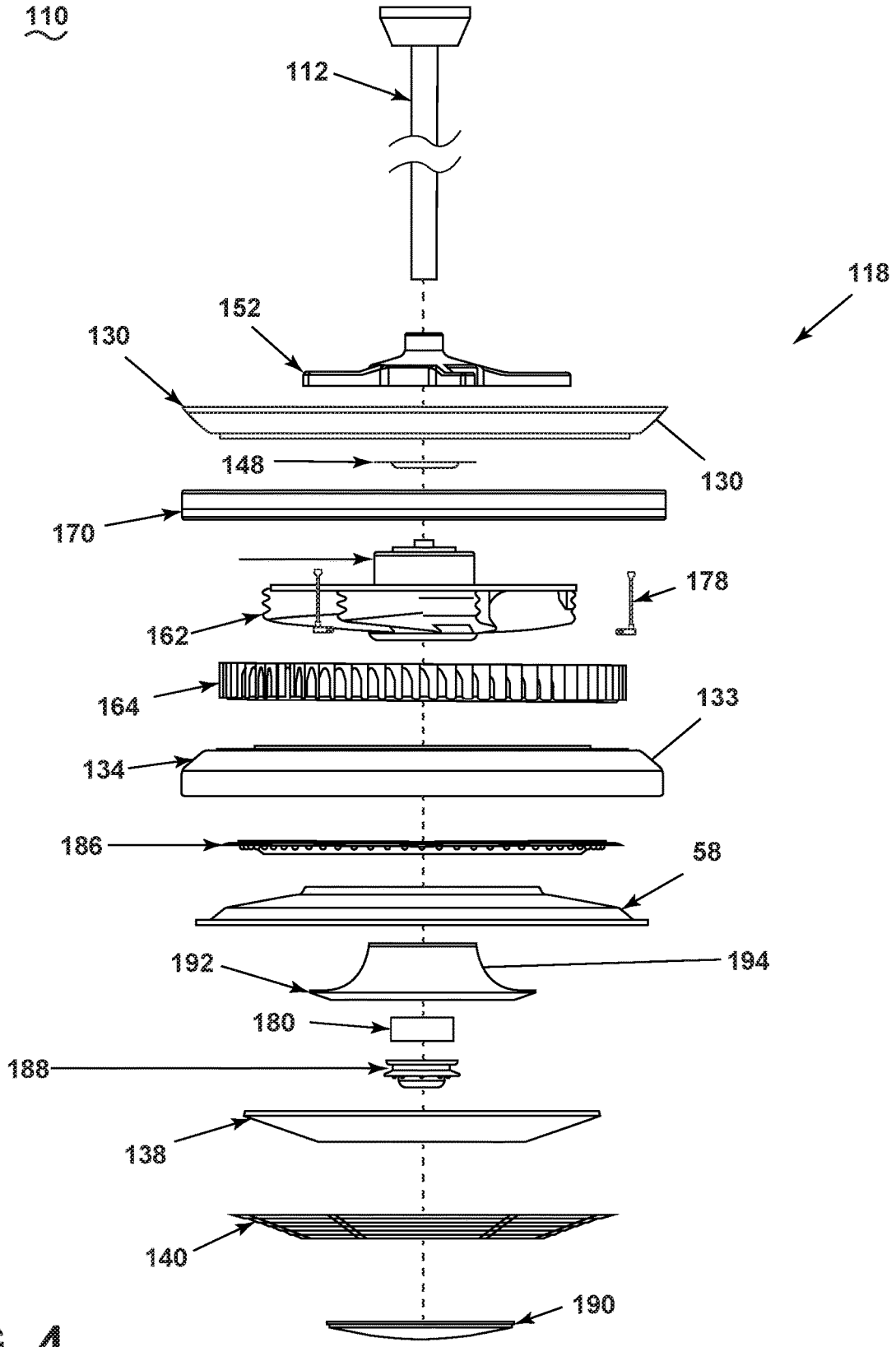
FIG. 4 is an exploded view of an alternative ceiling fan.
Figure 5:
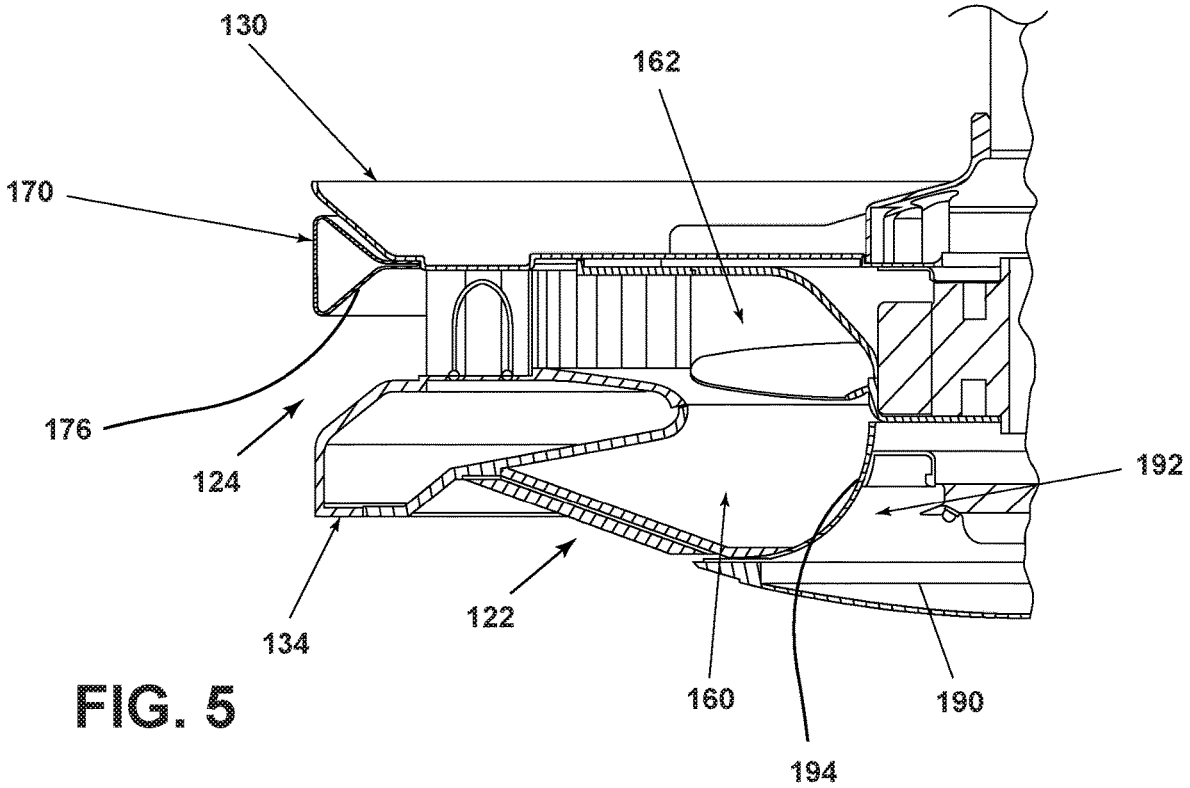
FIG. 5 is an enlarged detail view of the ceiling fan of FIG. 4 showing a deflector in a first position.
Figure 6:
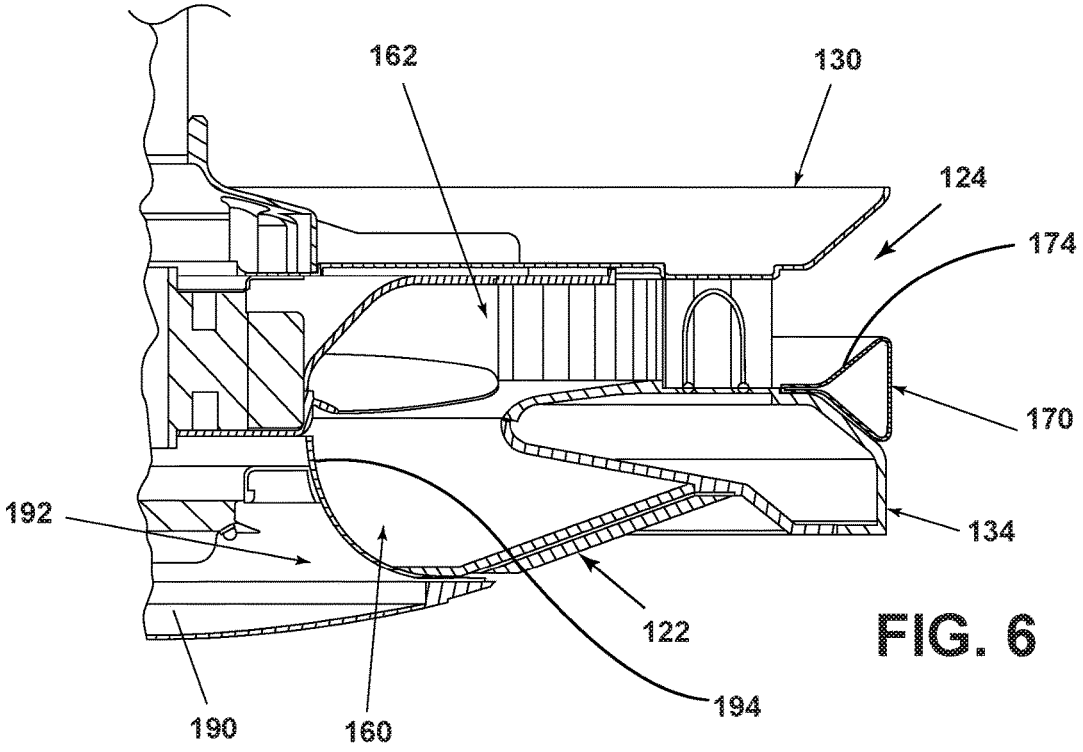
FIG. 6 is an enlarged detail view of the ceiling fan of FIG. 5 showing the deflector in a second position.

FIG. 4 illustrates and exploded view of another embodiment of a ceiling fan 110. The ceiling fan 110 can be substantially similar to that of FIG. 3, with similar numerals increased by a value of one hundred, and the discussion will be limited to differences between the two. Furthermore, it should be appreciated that features shown in one embodiment are not necessarily exclusive to that embodiment, and it is contemplated that features may be interchanged among embodiments as may be desirable. It should be further understood that while elements such as an inlet 122 and an outlet 124 are not specifically visible in the exploded view, that the inlet 122, outlet 124, and interior passage 160, to the extent that they are similar to the prior figures, are included in a completed assembly of the ceiling fan 110. Such are best seen in FIGS. 5-6.

Still referring to FIG. 4, the ceiling fan 110 can include a light 188 electrically coupled to a controller 180. Additionally, a translucent lower light cover 190 can be utilized to cover the bottom of the ceiling fan 110, while permitting light to pass through.

The impeller shroud 134 includes a second angled edge 133, which can be sized and shaped similar to, but opposite of the angled edge 132 of the top plate 130. In another example, an annular lighting element 186 can be provided, such as an ultraviolet light, which can be used to treat the air passing through the ceiling fan 110. Alternatively, the lighting element 186 can be a heating element or heat exchanger, which can be provided and mounted within the body 118 and within the interior passage 160. In one example, the heating element can be provided within the interior passage 160, downstream of the impeller 162, such that air or fluid pushed by the impeller 162 can be heated by the heating element and then exhausted from the outlet 124. In this way, the airflow moved by the ceiling fan 110 can be heated. Additionally, it is contemplated that the heating element 16 can be a cooling element, or a combination heating and cooling element, or other heat exchanger element, which can be utilized to cool or heat the airflow moved through the ceiling fan 110. In another example, the heating element could optionally be or include a positive ion generator configured to discharge positive ions into the air or fluid, which can be used to reduce or minimize contaminants within the air. Another example could include an ultraviolet radiator, which can also be used to remove contaminants from the air.

An additional or alternative lighting element 188 can be utilized within the interior of the body 118, such as within the interior passage 160 upstream of the impeller 162. In such an example, light can escape through the filter cover 140 or bottom portion of the ceiling fan 110. Further, a bottom portion 190 can couple to the bottom of the impeller shroud 134, which can be translucent. The lighting element 188 can be mounted within the impeller shroud 134, permitting light to escape through the translucent bottom portion 190.

An additional bottom guide 192 can be incorporated with the rest of the body 118, and can include a curved exterior wall 194. It should be understood, however, that the exterior wall 194 When the bottom guide 192 is mounted within the body 118, it can be positioned about the motor 150, with the curved exterior wall 194 partially defining the interior passage 160. The curved exterior wall 194, when defining a portion of the interior passage 160, can provide for turning the air entering the interior passage 160 in order to reduce vibration and noise, as well as improving overall efficiency of the impeller 162 and the ceiling fan 110.

FIGS. 5 and 6 illustrate section views of the assembled ceiling fan 110 of FIG. 4. FIG. 5 shows the deflector 170 in the first position, adjacent the top plate 130, while FIG. 6 shows the deflector 170 in the second position adjacent the impeller shroud 134. While not visible in the exploded view of FIG. 4, the deflector 170 includes upper and lower angled surfaces 174, 176, similar to that shown in FIGS. 2A-2C. In FIGS. 5 and 6, one can also appreciate the curved exterior wall 194 of the bottom guide 192, which partially defines the interior passage 160, provides for turning the airflow as it moves along the interior passage 160. Furthermore, as one can appreciate, the combined shape of the bottom portion 190 of the impeller shroud 134 with the curved exterior wall 194 defines the geometry for the interior passage 160. In one example, as air enters the inlet 122 and is drawn toward the impeller 162, the cross-sectional area of the interior passage 160 decreases toward the impeller 162. Thus, the airflow moving toward the impeller 162 is accelerated, and provides for improving the efficiency of the ceiling fan 110, in addition to reducing vibration and noise, as well as improving impeller efficiency, ceiling fan efficiency, and reducing operational costs.

In operation, when the deflector 170 is in the first position as shown in FIG. 5, an exhausted airflow B is directed in a generally downward direction by the lower angled surface 176 of the deflector 170. Similarly, when the deflector 170 is in the second position, as shown in FIG. 6, exhausted airflow C is directed in a generally upward direction by the upper angled surface 174.

Although the embodiments of the present invention have been shown and described, it would be appreciated by those skilled in the art that changes may be made in these embodiments without departing from the principles and spirit of the invention. Although specific terms are employed herein, they are used in a generic and descriptive sense only and not for purposes of limitation.

This written description uses examples to disclose the invention, including the best mode, and to enable any person skilled in the art to practice the invention, including making and using any devices or systems and performing any incorporated methods. The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A ceiling fan comprising:

a body defining an interior passage having an inlet and an outlet provided on the body;

a motor located within the body;

an impeller located within the body and rotatably driven by the motor to draw a volume of air through the interior passage from the inlet to the outlet; and a deflector coupled to the body with an upper angled surface and a lower angled surface, separate from the upper angled surface, each of the upper angled surface and lower angled surface diverging relative to the other and arranged at the outlet, such that the volume of air exhausted from the outlet can be selectively directed in an upward direction by the upper angled surface or in a downward direction by the lower angled surface.

2. The ceiling fan of claim 1 wherein the inlet, the outlet, and the interior passage are annular.

3. The ceiling fan of claim 1 further comprising an actuator operably coupled to the deflector for moving the deflector between a first position and a second position.

4. The ceiling fan of claim 3 further comprising a controller operably coupled to the actuator for controlling movement of the deflector between the first position and the second position.

5. The ceiling fan of claim 3 wherein when the deflector is in the first position, air exhausted from the outlet confronts the lower angled surface and is directed in the downward direction.

6. The ceiling fan of claim 4 wherein when the deflector is in the second position, air exhausted from the outlet confronts the upper angled surface and is directed in the upward direction.

7. The ceiling fan of claim 1 wherein the body includes a top plate which at least partially defines the interior passage and further includes an angled edge shaped complementary to the upper angled surface of the deflector.

8. The ceiling fan of claim 7 wherein the body further includes an impeller shroud spaced from the top plate, defining an annular peripheral gap as the space between the body and the impeller shroud.

9. The ceiling fan of claim 8 wherein the peripheral gap defines the outlet of the interior passage, and the deflector extends through the peripheral gap.

10. The ceiling fan of claim 8 wherein the impeller shroud further includes a second angled edge, shaped complementary to the lower angled surface of the deflector.

11. The ceiling fan of claim 1 further comprising a controller operably connected to the ceiling fan for operating the ceiling fan and to move the deflector between a first position and a second position.

12. The ceiling fan of claim 1 further comprising a light kit.

13. The ceiling fan of claim 12 further comprising a translucent lower cover coupled to the body and covering the light kit.

14. The ceiling fan of claim 1 further comprising a filter provided at the inlet.

15. The ceiling fan of claim 14 further comprising a filter cover coupled to the body covering the filter.

16. The ceiling fan of claim 1 further comprising one or more of an ultraviolet light generator emitting ultraviolet light into the interior passage, a positive ion generator emitting positive ions into the interior passage, or a heat exchanger heating or cooling air within the interior passage.

17. The ceiling fan of claim 1 further comprising a set of guides positioned within the interior passage.

18. A ceiling fan comprising:

a motor housing including an annular interior passage extending from an annular inlet to an annular outlet, with the annular outlet including a first angled edge spaced from a second angled edge by a peripheral gap;

a downrod for suspending the motor housing from a structure;

a motor provided within the motor housing;

an impeller provided within the interior passage for moving a volume of air from the inlet to the outlet;

a deflector extending through the peripheral gap including an upper angled surface and a lower angled surface, with the upper angled surface shaped complementary to the first angled edge of the annular outlet and with the lower angled surface shaped complementary to the second angled edge;

wherein the deflector directs air exhausting from the outlet in a generally upward direction when the deflector is in a first position with the lower angled surface confronting the second angled edge and wherein the deflector directs air exhausting from the outlet in a generally downward direction when the deflector is in a second position with the upper angled surface confronting the first angled edge.

19. The ceiling fan of claim 18 further comprising an actuator operably coupled to the deflector to move the deflector between the first position and the second position.

20. A ceiling fan comprising:

a motor housing body including an annular inlet and an annular outlet; and a deflector positioned at and partially defining the outlet, with the deflector including an upper angled surface and a lower angled surface, separate from the upper angled surface, each of the upper angled surface and lower angled surface diverging relative to the other;

wherein the deflector is movable between a first position and a second position, where the deflector directs air exhausting from the outlet in a generally downward direction along the lower angled surface in the first position, and where the deflector directs air exhausting from the outlet in a generally upward direction along the upper angled surface in the second position.

* * * * *